US005774822A

United States Patent [19]

Maki et al.

[11] Patent Number: 5,774,822

[45] **Date of Patent: *Jun. 30, 1998**

[54] FUEL METERING CONTROL SYSTEM FOR INTERNAL COMBUSTION ENGINE

[75] Inventors: Hidetaka Maki; Isao Komoriya, both of Wako, Japan

[73] Assignee: Honda Giken Kogyo Kabushiki Kaisha, Tokyo, Japan

[ * ] Notice: The term of this patent shall not extend beyond the expiration date of Pat. No. 5,606,959.

[21] Appl. No.: 606,383

[22] Filed: Feb. 23, 1996

[30] Foreign Application Priority Data

Feb. 25, 1995 [JP] Japan ..... 7-061664

[51] Int. Cl.[6] ..... G06G 7/70; F02M 23/00

[52] U.S. Cl. ..... 701/104; 701/103; 123/673; 123/677; 123/680; 123/480

[58] Field of Search ..... 364/431.01, 431.03, 364/431.04, 431.051, 431.052, 431.053; 123/673, 674, 675, 677, 680, 679, 696, 687, 480, 685, 478, 492, 571; 60/274, 275, 277, 276, 284, 285; 73/116, 117.3, 118.2

[56] References Cited

U.S. PATENT DOCUMENTS

| | | | |
|---|---|---|---|
| 5,349,933 | 9/1994 | Hasegawa et al. | 123/486 |
| 5,367,462 | 11/1994 | Klenk et al. | 364/431.052 |
| 5,448,978 | 9/1995 | Hasegawa et al. | 123/480 |
| 5,462,037 | 10/1995 | Hasegawa et al. | 123/673 |
| 5,548,514 | 8/1996 | Hasegawa et al. | 364/431.051 |
| 5,549,092 | 8/1996 | Hasegawa et al. | 123/478 |
| 5,558,075 | 9/1996 | Maki et al. | 123/680 |
| 5,558,076 | 9/1996 | Maki et al. | 123/687 |
| 5,572,977 | 11/1996 | Shibata et al. | 364/431.051 |
| 5,590,638 | 1/1997 | Nishimura et al. | 123/687 |
| 5,606,959 | 3/1997 | Maki et al. | 364/431.051 |
| 5,629,853 | 5/1997 | Ogawa et al. | 364/431.051 |
| 5,632,261 | 5/1997 | Maki et al. | 123/674 |
| 5,636,621 | 6/1997 | Maki et al. | 123/673 |

FOREIGN PATENT DOCUMENTS

| | | |
|---|---|---|
| 2-275043 | 11/1990 | Japan . |
| 4-209940 | 7/1992 | Japan . |

OTHER PUBLICATIONS

"Digital Adaptive Control" *Computrol,* No. 27, Jul. 10, 1989, pp. 28–41.

"Automatic Control Handbook", Ohm, Ltd., Japan, pp. 701–707.

"A Survey of Model Reference Adaptive Techniques—Theory and Applications", Landau, *Automatica,* vol. 10, 1974, pp. 353–379.

"Unification of Discrete Time Explicit Model Reference Adaptive Control Designs", Landau et al, *Automatica,* vol. 17, No. 4, 1981, pp. 593–611.

"Combining Model Reference Adaptive Controllers and Stochastic Self–tuning Regulators", Landau, *Automatica,* vol. 18, No. 1, 1982, pp. 77–84.

*Primary Examiner*—Jacques H. Louis-Jacques
*Attorney, Agent, or Firm*—Nikaido, Marmelstein, Murray & Oram LLP

[57] ABSTRACT

A system for controlling fuel metering for a multi-cylinder internal combustion engine having a feedback loop which has an adaptive controller and an adaptation mechanism coupled to said adaptive controller for estimating controller parameters $\hat{\theta}$. The adaptive controller calculates a feedback correction coefficient using internal variables that include the controller parameters $\hat{\theta}$, to correct a basic quantity of fuel injection to bring a detected air/fuel ratio to a desired air/fuel ratio determined earlier from the detected air/fuel ratio by a dead time d'. The dead time d' is properly determined to be corresponding to a time k at which the air/fuel ratio is detected. Alternatively, the dead time may be determined to be longer than the proper value to eventually improve vehicle drivability, or determined to be shorter than the proper value to compensate for insufficient fuel adhesion correction.

46 Claims, 10 Drawing Sheets

FUEL METERING CONTROL SYSTEM FOR INTERNAL COMBUSTION ENGINE

BACKGROUND OF THE INVENTION

1. Field of the Invention

This invention relates to a fuel metering control system for an internal combustion engine.

2. Description of the Related Art

The PID control law is ordinarily used for fuel metering control for internal combustion engines. The control error between the desired value and the controlled variable (plant output) is multiplied by a P term (proportional term), an I term (integral term) and a D term (differential or derivative term) to obtain the feedback correction coefficient (feedback gain). In addition, it has recently been proposed to obtain the feedback correction coefficient by use of modern control theory or the like, as taught by Japanese Laid-Open Patent Application Hei 4(1992)-209,940.

The feedback control will be conducted based on modern control theory like an adaptive controller such that an air/fuel ratio or the quantity of fuel injection is brought to a desired value, using the amount of fuel injection as the manipulated variable. In conducting such a control, there arises a problem that the response of an air/fuel ratio sensor is not the same between when the air-fuel mixture is stoichiometric and when the air-fuel mixture is lean. This will disadvantageously cause a dead time to vary markedly, when the desired air/fuel ratio is changed sharply in a fuel metering control such as a lean burn control. Here, the dead time indicates a time or period until a change of the desired air/fuel ratio has come out as a change in the detected air/fuel ratio. Theoretically, incorrectly determined dead time degrades adaptive control.

SUMMARY OF THE INVENTION

An object of the invention is therefore to provide a fuel metering control system for an internal combustion engine having an adaptive controller, which can properly determine a dead time of the desired value in response to the operating condition of the engine, thereby enhancing control performance and response of the system.

The above will, on the other hand, mean that the control performance or response of the system can be lowered by intentionally varying a dead time of the desired value. When the desired air/fuel ratio is switched from a lean value to a stoichiometric value in a lean burn controlled engine, for example, it is preferable, from the viewpoint of the vehicle drivability, to cause the controlled variable to follow the change of the desired value slowly so as to decrease torque shock.

A second object of the invention is therefore to provide a fuel metering control system for an internal combustion engine having an adaptive controller, which can intentionally vary a dead time of the desired value used in the adaptive controller calculation, thereby enhancing vehicle drivability.

This invention achieves the object by providing a system for controlling fuel metering for a multi-cylinder internal combustion engine, comprising an air/fuel ratio sensor located in an exhaust system of the engine for detecting an air/fuel ratio in exhaust gas of the engine, engine operating condition detecting means for detecting engine operating conditions including at least engine speed and engine load, basic fuel injection quantity determining means coupled to said engine operating condition detecting means, for determining a basic quantity of fuel injection for a cylinder of the engine based on at least the detected engine operating conditions, a feedback loop means coupled to said fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained at least based on the detected air/fuel ratio to a desired value determined earlier by a dead time, output fuel injection quantity determining means for determining an output quantity of fuel injection, said output fuel injection quantity determining means correcting the basic quantity of fuel injection using said feedback correction coefficient when engine operation is discriminated to be in a feedback control region, and fuel injection means coupled to said output fuel injection quantity determining means, for injecting fuel into the cylinder of the engine based on the output quantity of fuel injection. In the system, dead time determining means are operatively coupled to said feedback loop means, for determining the dead time in response to the detected engine operating conditions.

BRIEF EXPLANATION OF THE DRAWINGS

These and other objects and advantages of the invention will be more apparent from the following description and drawings, which show the invention by way of example only, and in which.

DETAILED DESCRIPTION OF THE PREFERRED EMBODIMENTS

Embodiments of the invention, given by way of example only, will now be explained with reference to the drawings.

Figure 1:
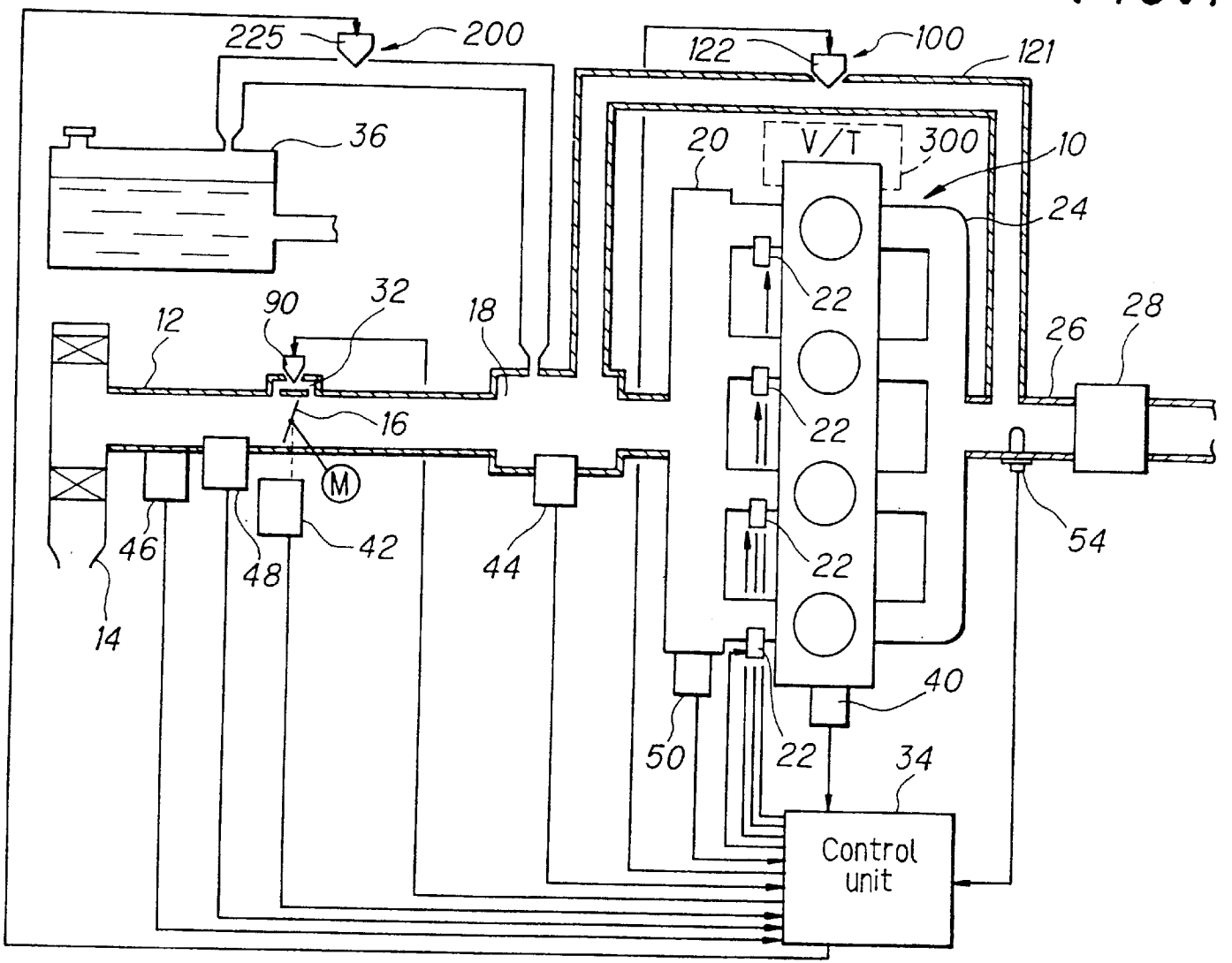
FIG. 1 is an overall schematic view showing a fuel metering control system for an internal combustion engine according to the present invention.

FIG. 1 is an overview of a fuel metering control system for an internal combustion engine according to the invention.

Reference numeral 10 in this figure designates an overhead cam (OHC) in-line four-cylinder (multi-cylinder) internal combustion engine. Air drawn into an air intake pipe 12 through an air cleaner 14 mounted on a far end thereof is supplied to each of the first to fourth cylinders through a surge tank 18, an intake manifold 20 and two intake valves (not shown), while the flow thereof is adjusted by a throttle valve 16. A fuel injector (fuel injection means) 22 is installed in the vicinity of the intake valves of each cylinder for injecting fuel into the cylinder. The injected fuel mixes with the intake air to form an air-fuel mixture that is ignited in the associated cylinder by a spark plug (not shown) in the firing order of #1, #3, #4 and #2 cylinder. The resulting combustion of the air-fuel mixture drives a piston (not shown) down.

The exhaust gas produced by the combustion is discharged through two exhaust valves (not shown) into an exhaust manifold 24, from where it passes through an exhaust pipe 26 to a catalytic converter (three-way catalyst) 28 where noxious components are removed therefrom before it is discharged to the exterior. Not mechanically linked with the accelerator pedal (not shown), the throttle valve 16 is controlled to a desired degree of opening by a stepping motor M. In addition, the throttle valve 16 is bypassed by a bypass 32 provided at the air intake pipe 12 in the vicinity thereof.

The engine 10 is equipped with an exhaust gas recirculation (EGR) mechanism 100 which recirculates a part of the exhaust gas to the intake side via a recirculation pipe 121, and a canister purge mechanism 200 connected between the air intake system and a fuel tank 36.

The engine 10 is also equipped with a variable valve timing mechanism 300 (denoted as V/T in FIG. 1).

As taught by Japanese Laid-open Patent Application No. Hei 2(1990)-275,043, for example, the variable valve timing mechanism 300 switches the opening/closing timing of the intake and/or exhaust valves between two types of timing characteristics: a characteristic for low engine speed designated LoV/T, and a characteristic for high engine speed designated HiV/T in response to engine speed Ne and manifold pressure Pb. Since this is a well-known mechanism, however, it will not be described further here. (Among the different ways of switching between valve timing characteristics is included that of deactivating one of the two intake valves.)

The engine 10 of FIG. 1 is provided in its ignition distributor (not shown) with a crank angle sensor 40 for detecting the piston crank angle and is further provided with a throttle position sensor 42 for detecting the degree of opening of the throttle valve 16, and a manifold absolute pressure sensor 44 for detecting the pressure Pb of the intake manifold downstream of the throttle valve 16 in terms of absolute value. An atmospheric pressure sensor 46 for detecting atmospheric pressure Pa is provided at an appropriate portion of the engine 10, an intake air temperature sensor 48 for detecting the temperature of the intake air is provided upstream of the throttle valve 16, and a coolant temperature sensor 50 for detecting the temperature of the engine coolant is also provided at an appropriate portion of the engine. The engine 10 is further provided with a valve timing (V/T) sensor 52 (not shown in FIG. 1) which detects the valve timing characteristic selected by the variable valve timing mechanism 300 based on oil pressure.

Further, an air/fuel sensor 54 constituted as an oxygen detector or oxygen sensor is provided in the exhaust pipe 26 at, or downstream of, a confluence point in the exhaust system, between the exhaust manifold 24 and the catalytic converter 28, where it detects the oxygen concentration in the exhaust gas at the confluence point and produces a corresponding signal (explained later). The outputs of the sensors are sent to the control unit 34.

Figure 2:
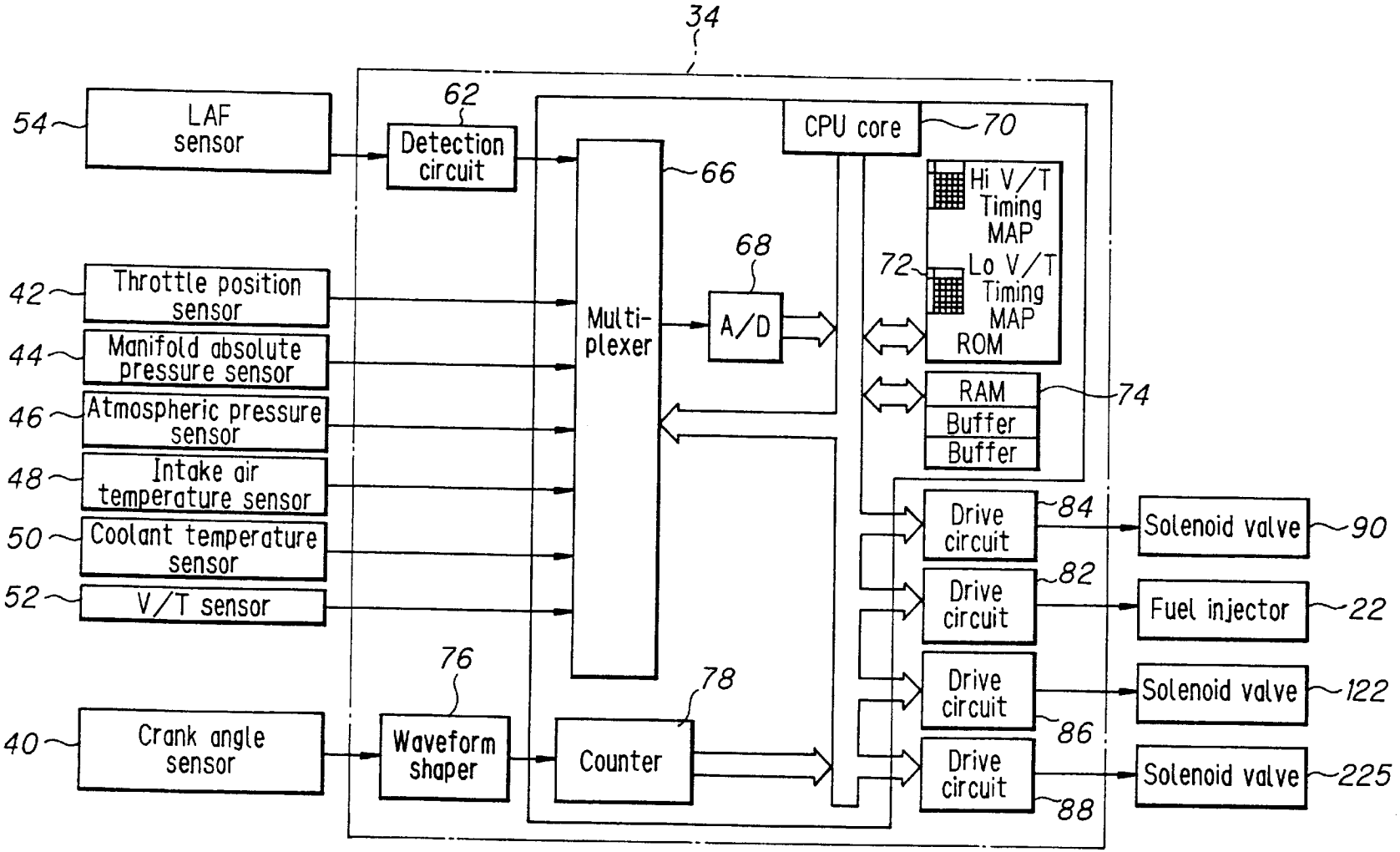
FIG. 2 is a block diagram showing the details of a control unit illustrated in FIG. 1.

Details of the control unit 34 are shown in the block diagram of FIG. 2. The output of the air/fuel ratio sensor 54 is received by a detection circuit 62, where it is subjected to appropriate linearization processing for producing an output characterized in that it varies linearly with the oxygen concentration of the exhaust gas over a broad range extending from the lean side to the rich side. (The air/fuel ratio sensor is denoted as "LAF sensor" in the figure and will be so referred to in the remainder of this specification.)

The output of the detection circuit 62 is forwarded through a multiplexer 66 and an A/D converter 68 to a CPU (central processing unit). The CPU has a CPU core 70, a ROM (read-only memory) 72 and a RAM (random access memory) 74, and the output of the detection circuit 62 is A/D-converted once every prescribed crank angle (e.g., 15 degrees) and stored in buffers of the RAM 74. Similarly, the analog outputs of the throttle position sensor 42, etc., are input to the CPU through the multiplexer 66 and the A/D converter 68 and stored in the RAM 74.

The output of the crank angle sensor 40 is shaped by a waveform shaper 76 and has its output value counted by a counter 78. The result of the count is input to the CPU. In accordance with commands stored in the ROM 72, the CPU core 70 computes a manipulated variable in the manner described later and drives the fuel injectors 22 of the respective cylinders via a drive circuit 82. Operating via drive circuits 84, 86 and 88, the CPU core 70 also drives a solenoid valve (EACV) 90 (for opening and closing the bypass 32 to regulate the amount of secondary air), a solenoid valve 122 for controlling the aforesaid exhaust gas recirculation, and a solenoid valve 225 for controlling the aforesaid canister purge.

Figure 3:
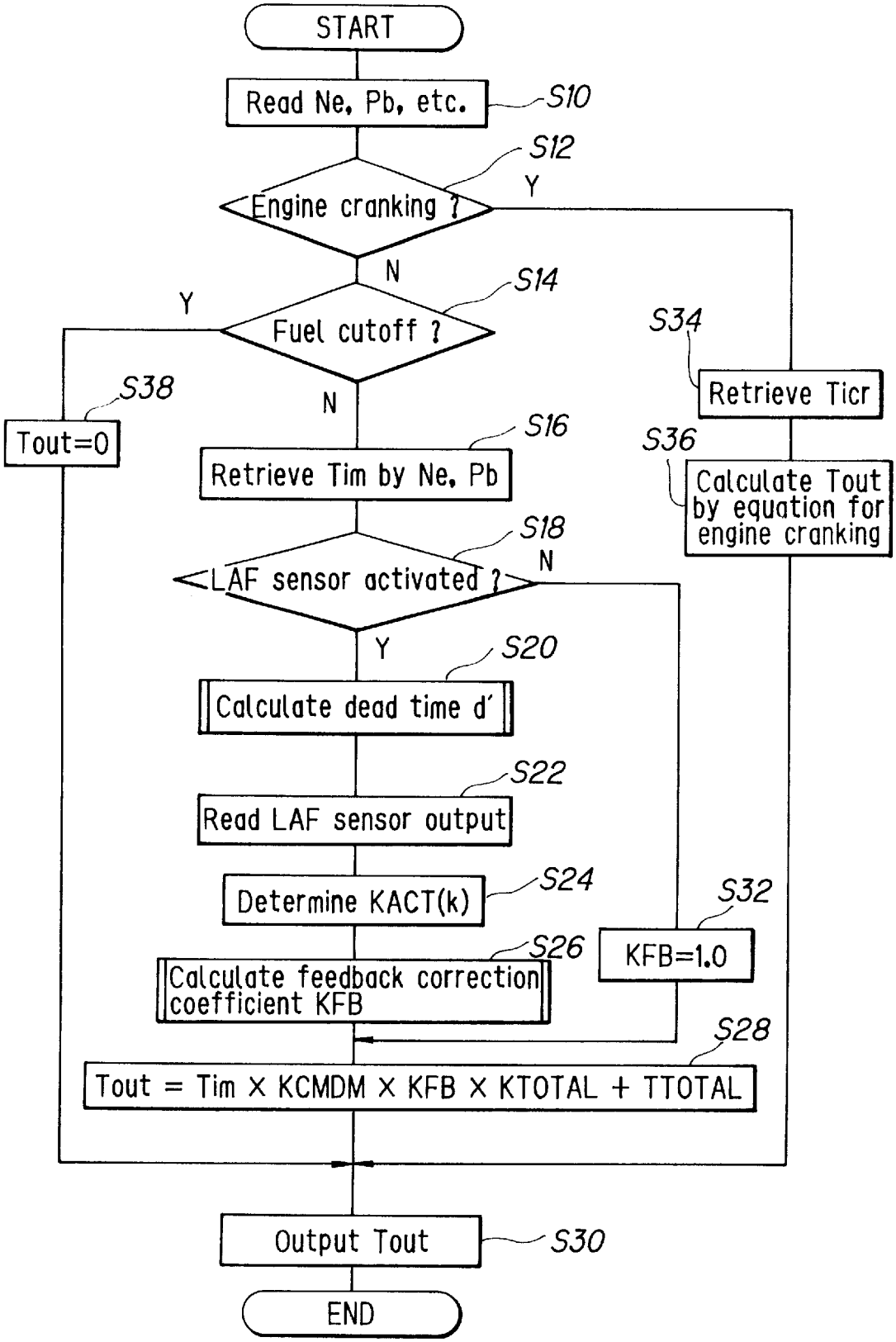
FIG. 3 is a flowchart showing the operation of the system according to the invention.

FIG. 3 is a flowchart showing the operation of the system. The program is activated at a predetermined crank angular position such as every TDC (Top Dead Center) of the engine.

Figure 4:
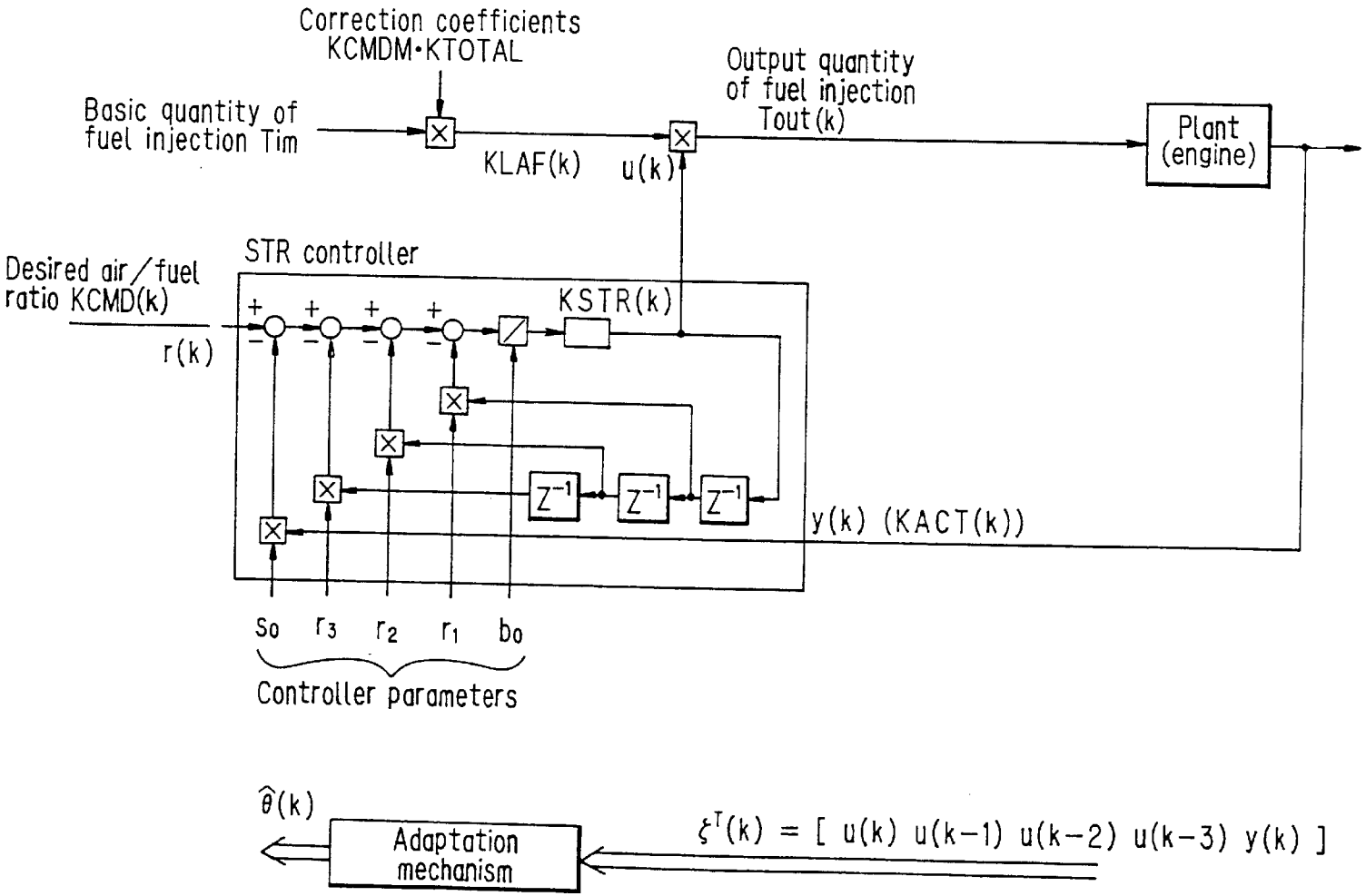
FIG. 4 is a block diagram showing the configuration of the system.

In the system, as disclosed in the FIG. 4 block diagram, there is provided a controller means for calculating a feedback correction coefficient (shown as "KSTR(k)" in the figure) using a control law expressed in recursion formula, more particularly an adaptive controller of a type of STR (self-tuning regulator, shown as "STR controller" in the figure) to determine the manipulated variable in terms of the amount of fuel supply (shown as "Basic quantity of fuel injection Tim" in the figure), such that the detected exhaust air/fuel ratio (shown as "KACT(k)" in the figure) is brought to a desired air/fuel ratio (shown as "KCMD(k)" in the figure). Here, k means a sample number in the discrete time system.

It should be noted that the detected air/fuel ratio and the desired air/fuel ratio are expressed as, in fact, the equivalence ratio, i.e., as Mst/M=1/lambda (Mst: stoichiometric air/fuel ratio; M: A/F (A: air mass flow rate; F: fuel mass flow rate; lambda: excess air factor), so as to facilitate the calculation.

In FIG. 3, the program starts at S10 in which the detected engine speed Ne, the manifold pressure Pb, etc., are read and the program proceeds to S12 in which it is checked whether or not the engine is cranking, and if it is not, to S14 in which it is checked whether the supply of fuel is cut off. Fuel cutoff is implemented under a specific engine operating condition, such as when the throttle is fully closed and the engine speed is higher than a prescribed value, at which time the supply of fuel is stopped and fuel injection is controlled in an open-loop manner.

When it is found in S14 that fuel cutoff is not implemented, the program proceeds to S16 in which the basic quantity of fuel injection Tim is calculated by retrieval from mapped data using the detected engine speed Ne and manifold pressure Pb as address data. Next, the program proceeds to S18 in which it is checked whether activation of the LAF sensor 54 is complete. This is done by comparing the difference between the output voltage and the center voltage of the LAF sensor 54 with a prescribed value (0.4 V, for example) and determining that the activation has been completed when the difference is smaller than the prescribed value.

When S18 finds that the activation has been completed, the program goes to S20 in which the dead time d' is calculated. The dead time d' is, as mentioned before, a time or period before KCMD is reflected in KACT, in other words, the time for the desired value (i.e., KCMD(k−d')) to correspond to the detected value (i.e., KACT(k)).

For ease of understanding, the calculation of the dead time will be explained after explaining a feedback correction coefficient. In the embodiment, the control cycle (program loop) is conducted in synchronism with the predetermined crank angular position such as the TDC, the dead time d' is expressed as a time or period determined in terms of the crank angle, more specifically expressed as the number of the TDC intervals. It should of course be noted that if the control cycle is defined with respect to a time counter, the dead time d' will be defined with respect to time. In that sense, the dead time d' is used in the specification to mean a time or period defined with respect to the crank angular position. At any rate, the dead time d' should include a time or period defined by the crank angular position, a time counter value or some similar parameters.

In the FIG. 3 flowchart, the program proceeds to S22 in which the output of the LAF sensor is read, and to S24 in which the air/fuel ratio KACT(k) is determined or detected. The program then goes to S26 in which a feedback correction coefficient KFB is calculated.

Figure 5:
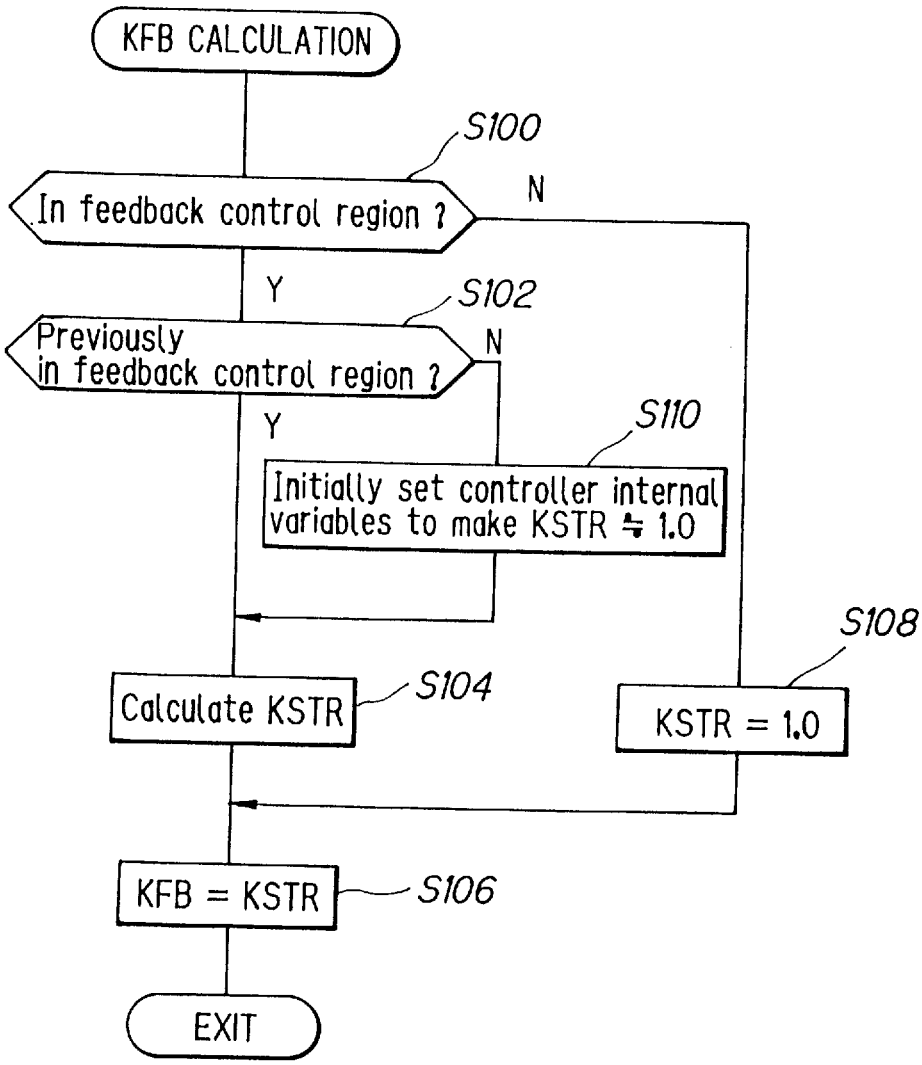
FIG. 5 is a subroutine flowchart of FIG. 3 showing the calculation of a feedback correction coefficient KFB referred to in FIG. 3.

FIG. 5 is a flowchart showing the calculation of the feedback correction coefficient KFB.

The program starts at S100 in which it is checked whether the engine operation is in a feedback control region. This is conducted using a separate subroutine not shown in the drawing. Fuel metering is controlled in an open-loop fashion, for example, such as during full-load enrichment or high engine speed, or when the engine operating condition has changed suddenly owing to the operation of the exhaust gas recirculation mechanism.

When the result in S100 is YES, the program proceeds to S102 in which it is checked whether the engine operating condition at the preceding (control) cycle, i.e., at the time that the FIG. 3 flowchart was activated in the preceding (control) cycle, was in the feedback control region. When the result is affirmative, the program proceeds to S104 in which the feedback correction coefficient is calculated using the adaptive control law. The feedback correction coefficient will hereinafter be referred to as the "adaptive correction coefficient KSTR".

Explaining this, the system illustrated in FIG. 4 is based on adaptive control technology proposed in an earlier application by the assignee. It comprises an adaptive controller constituted as an STR (self-tuning regulator) controller (controller means) and an adaptation mechanism (adaptation mechanism means) (system parameter estimator) for estimating/identifying the controller parameters (system parameters) (dynamic engine characteristic parameters) $\hat{\theta}$. The desired value and the controlled variable (plant output) of the fuel metering feedback control system are input to the STR controller, which receives the coefficient vector (i.e., the controller parameters expressed in a vector) $\hat{\theta}$ estimated/identified by the adaptation mechanism, and generates an output.

One identification or adaptation law (algorithm) available for adaptive control is that proposed by I. D. Landau et al. In the adaptation law proposed by I. D. Landau et al., the stability of the adaptation law expressed in a recursion formula is ensured at least using Lyapunov's theory or Popov's hyperstability theory. This method is described in, for example, *Computrol* (Corona Publishing Co., Ltd.) No. 27, pp. 28–41; *Automatic Control Handbook* (Ohm Publishing Co., Ltd.) pp. 703–707; "A Survey of Model Reference Adaptive Techniques—Theory and Applications" by I. D. Landau in *Automatica*, Vol. 10, pp. 353–379, 1974; "Unification of Discrete Time Explicit Model Reference Adaptive Control Designs" by I. D. Landau et al. in *Automatica*, Vol. 17, No. 4, pp. 593–611, 1981; and "Combining Model Reference Adaptive Controllers and Stochastic Self-tuning Regulators" by I. D. Landau in *Automatica, Vol.* 18, No. 1, pp. 77–84, 1982.

The adaptation or identification algorithm of I. D. Landau et al. is used in the assignee's earlier proposed adaptive control technology. In this adaptation or identification algorithm, when the polynomials of the denominator and numerator of the transfer function $B(Z^{-1})/A(Z^{-1})$ of the discrete controlled system are defined in the manner of Eq. 1 and Eq. 2 shown below, then the controller parameters or system (adaptive) parameters $\hat{\theta}(k)$ are made up of parameters as shown in Eq. 3 and are expressed as a vector (transpose vector). And the input zeta (k) which is input to the adaptation mechanism becomes that shown by Eq. 4. Here, there is taken as an example a plant in which m=1, n=1 and d=3, namely, the plant model is given in the form of a linear system with three control cycles of dead time.

$$A(z^{-1})=1+a_1z^{-1}+\ldots+a_nz^{-n} \quad \text{Eq. 1}$$

$$B(z^{-1})=b_0+b_1z^{-1}+\ldots+b_mz^{-m} \quad \text{Eq. 2}$$

$$\hat{\theta}^T(k)=[\hat{b}_0(k),\hat{B}_R(z^{-1},k),\hat{S}(z^{-1},k)]=[\hat{b}_0(k),\hat{r}_1(k),\ldots,r_{m+d-1}(k),s_0(k),\ldots,s_{n-1}(k)]=[b_0(k),r_1(k),r_2(k),r_3(k),s_0(k)] \quad \text{Eq. 3}$$

$$\leq^T(k)=[u(k),\ldots,u(k-m-d+1),y(k),\ldots,y(k-n+1)]=[u(k),u(k-1),u(k-2),u(k-3),y(k)] \quad \text{Eq. 4}$$

Here, the factors of the controller parameters $\hat{\theta}$, i.e., the scalar quantity $\hat{b}_0^{-1}(k)$ that determines the gain, the control factor $\hat{B}_R(Z^{-1},k)$ that uses the manipulated variable and $\hat{S}(Z^{-1},k)$ that uses the controlled variable, all shown in Eq. 3, are expressed respectively as Eq. 5 to Eq. 7.

$$\hat{b}_0^{-1}(k)=1/b_0 \quad \text{Eq. 5}$$

$$\hat{B}_R(Z^{-1},k)=r_1z^{-1}+r_2z^{-2}+\ldots+r_{m+d-1}z^{-(m+d-1)}=r_1z^{-1}+r_2z^{-2}+r_3z^{-3} \quad \text{Eq. 6}$$

$$\hat{S}(Z^{-1},k)=s_0+S_1z^{-1}+\ldots+s_{n-1}z^{-(n-1)}=s_0 \quad \text{Eq. 7}$$

As shown in Eq. 3, the adaptation mechanism estimates or identifies each coefficient of the scalar quantity and control factors, calculates the controller parameters (vector) $\hat{\theta}$, and supplies the controller parameters $\hat{\theta}$ to the STR controller. More specifically, the adaptation mechanism calculates the controller parameters $\hat{\theta}$ using the manipulated variable u(i) and the controlled variable y (j) of the plant (i,j include past values) such that the control error between the desired value and the controlled variable becomes zero.

More precisely, the controller parameters (vector) $\hat{\theta}(k)$ are calculated by Eq. 8 below. In Eq. 8, $\Gamma(k)$ is a gain matrix (the (m+n+d)th order square matrix) that determines the estimation/identification rate or speed of the controller parameters $\hat{\theta}$, and $e^*(k)$ is a signal indicating the generalized estimation/identification error, i.e., an estimation error signal of the controller parameters. They are represented by recursion formulas such as those of Eqs. 9 and 10.

$$\hat{\theta}(k)=\hat{\theta}(k-1)+r(k-1)\leq(k-d)e^*(k) \quad \text{Eq. 8}$$

$$\Gamma(k)=\frac{1}{\lambda_1(k)}\left[\Gamma(k-1)-\frac{\lambda_2(k)\Gamma(k-1)\zeta(k-d)\zeta^T(k-d)\Gamma(k-1)}{\lambda_1(k)+\lambda_2(k)\zeta^T(k-d)\Gamma(k-1)\zeta(k-d)}\right] \quad \text{Eq. 9}$$

$$e^*(k)=\frac{D(z^{-1})y(k)-\hat{\theta}^T(k-1)\zeta(k-d)}{1+\zeta^T(k-d)\Gamma(k-1)\zeta(k-d)} \quad \text{Eq. 10}$$

Various specific algorithms are given depending on the selection of lambda 1(k) and lambda 2(k) in Eq. 9. lambda 1(k)=1, lambda 2(k)=lambda (*0*<lambda<2) gives the gradually-decreasing gain algorithm (least-squares method when lambda=1); and lambda 1(k)=lambda 1(0<lambda 1<1), lambda 2(k)=lambda 2(0<lambda 2<lambda) gives the variable-gain algorithm (weighted least-squares method when lambda 2=1). Further, defining lambda 1(k)/lambda 2(k)=σ and representing lambda 3(k) as in Eq. 11, the constant-trace algorithm is obtained by defining lambda 1(k)=lambda 3(k). Moreover, lambda 1(k)=1, lambda 2(k)=0 gives the constant-gain algorithm. As is clear from Eq. 9, in this case $\Gamma(k)=\Gamma(k-1)$, resulting in the constant value $\Gamma(k)=\Gamma$. Any of the algorithms are suitable for the time-varying plant such as the fuel metering control system according to the invention.

$$\lambda_3(k)=1-\frac{\|\Gamma(k-1)\zeta(k-d)\|^2}{\sigma+\zeta^T(k-d)\Gamma(k-1)\zeta(k-d)}\cdot\frac{1}{tr\Gamma(0)} \quad \text{Eq. 11}$$

In the diagram of FIG. 4, the STR controller (adaptive controller) and the adaptation mechanism (system parameter estimator) are placed outside the system for calculating the quantity of fuel injection (fuel injection quantity determining means) and operate to calculate the feedback correction coefficient KSTR(k) so as to adaptively bring the detected value KACT(k) to the desired value KCMD(k−d') (where, as mentioned earlier, d' is the dead time before KCMD is reflected in KACT). In other words, the STR controller receives the coefficient vector $\hat{\theta}(k)$ adaptively estimated/identified by the adaptive mechanism and forms a feedback compensator (feedback control loop) so as to bring it to the desired value KCMD(k−d'). The basic quantity of fuel injection Tim is multiplied by the calculated feedback correction coefficient KSTR(k), and the corrected quantity of fuel injection is supplied to the controlled plant (internal combustion engine) as the output quantity of fuel injection Tout(k).

Thus, the feedback correction coefficient KSTR(K) and the detected air/fuel ratio KACT(k) are determined and input to the adaptation mechanism, which calculates/estimates the controller parameters (vector) $\hat{\theta}(k)$ that are in turn input to the STR controller. Based on these values, the STR controller uses the recursion formula to calculate the feedback correction coefficient KSTR(k) so as to bring the detected air/fuel ratio KACT(k) to the desired air/fuel ratio KCMD (k−d'). The feedback correction coefficient KSTR(k) is specifically calculated as shown by Eq. 12:

$$KSTR(k)=\frac{KCMD(k-d')-s_0xy(k)-r_1\times KSTR(k-1)-r_2\times KSTR(k-2)-r_3\times KSTR(k-3)}{b_0} \quad \text{(Eq. 12}$$

Returning to FIG. 5, the program proceeds to S106 in which the adaptive correction coefficient KSTR, thus obtained, is renamed as the feedback correction coefficient KFB.

On the other hand, when S100 finds that the engine operating condition is not in the feedback control region, the program proceeds to S108 in which the adaptive correction coefficient KSTR is fixed at 1.0, and the program goes to S106. Since the quantity of fuel injection is multiplied by the feedback correction coefficient and is corrected, setting the correction coefficient to 1.0 indicates no feedback control should be implemented.

When S102 find that the last (control) cycle was not in the feedback control region, since this means that the engine operating condition has just shifted from the open-loop control region to the feedback control region, the program goes to S110 in which the internal variables of the controller parameters $\hat{\theta}$ including their past values are initially set, such that the adaptive correction coefficient KSTR becomes 1.0 or thereabout.

Specifically, the aforesaid adaptation mechanism receives zeta(k−d), i.e., a vector which is a set or group of the current and past values of the plant input u(k)(=KSTR(k)) and the plant output y(k)(=KACT(k)) and based on the cause-and-effect relationship of the plant input and output, calculates the controller parameters $\hat{\theta}$. Here, u(k) is the correction coefficient used for correcting the quantity of fuel injection, as just mentioned.

Therefore, in the case of initiating the adaptive control when the engine operating condition has just entered the feedback control region (adaptive control region), unless the past value of the internal variables of the adaptive (STR) controller such as zeta (k−d), $\hat{\theta}(k-1)$ and gain matrix $\Gamma(k-1)$ are prepared properly, there is the possibility that the adaptive correction coefficient KSTR will be calculated improperly. If the control is conducted using an improperly calculated adaptive correction coefficient, the system may, at worst, oscillate.

In view of the above, the system is configured in such a manner that the controller parameters $\hat{\theta}(k)$ are initially set such that the adaptive correction coefficient KSTR becomes 1.0 or thereabout assuming u(k−i)=1(i≧1), when the feedback control is started or resumed. And at the same time, the system is arranged in such a manner that zeta(k−d) is initially set as shown in Eq. 13. Since the gain matrix $\Gamma(k-1)$ is a value that determines the estimation/identification rate or speed of the controller parameters, the gain matrix is initially set to a predetermined matrix such as its initial value.

$$\begin{aligned}\zeta^T(k-d) &= [u(k-d)u(k-d-1)u(k-d-2)u(k-d-3)y(k-d)] \\ &= [KSTR(k-d)KSTR(k-d-1)KSTR(k-d-2)KSTR(k-d-3)KACT(k-d)] \\ &= [1 \quad 1 \quad 1 \quad 1 \quad KCMS(k-d')]\end{aligned} \qquad \text{Eq. 13}$$

More specifically, since the adaptive correction coefficient KSTR (K) is calculated as Eq. 12, the system is configured to determine the values at the previous control cycle (past values) $\hat{\theta}(k-1)$ and zeta (k–d) such that the adaptive correction coefficient KSTR becomes 1.0 or thereabout.

For example, assume that the desired air/fuel ratio KCMD (k–d')(expressed in the equivalence ratio) is 1.0, KSTR(k–1)=KSTR(k–2)=KSTR(k–3)=1.0, and the initial values of the factors of the controller parameters $\hat{\theta}(k)$ are:

$r_1=0.1$
$r_2=0.05$
$r_3=0.05$
$s_0=0.3$
$b_0=0.5$

If the detected air/fuel ratio KACT(k)(expressed in the equivalence ratio)=1.0, the adaptive correction coefficient KSTR is:

$$\begin{aligned}KSTR &= (1-0.1\times 1-0.05\times 1-0.05\times 1-0.3\times KACT(k))/0.5 \\ &= 1.0\end{aligned}$$

Thus, the adaptive correction coefficient KSTR is 1.0 or thereabout if the detected air/fuel ratio KACT(k) is 1.0 or thereabout.

This equals intentionally generating a past situation in which the adaptive correction coefficient KSTR(k–i)(i≧1) was 1.0 or thereabout, in other words, the detected air/fuel ratio KACT(k–j)(j≧1) was brought to a past desired air/fuel ratio KCMD(k–d') corresponding thereto and the control was stable.

With the arrangement, it becomes possible to initiate the feedback control with the adaptive correction coefficient KSTR starting from 1.0, when the engine operating condition has just moved from the open-loop control region to the feedback control region. Since the adaptive correction coefficient KSTR is fixed at 1.0 in the open-loop control, the feedback control can be started using the same value, enabling no control hunting to occur, no air/fuel ratio spike to occur and to improve the control stability.

Returning to the FIG. 3 flowchart, the program then proceeds to S28 in which the basic quantity of fuel injection (the amount of fuel supply) Tim is multiplied by a desired air/fuel ratio correction coefficient KCMDM (a value determined by correcting the desired air/fuel ratio (expressed in equivalence ratio) KCMD by the charging efficiency of the intake air), the feedback correction coefficient KFB and the product of other correction coefficients KTOTAL and is then added by the sum of additive correction terms TTOTAL to determine the output quantity of fuel injection Tout. The program then proceeds to S30 in which the output quantity of fuel injection Tout is applied to the fuel injector 22 as the manipulated variable.

Here, KTOTAL is the product of various correction coefficients to be made through multiplication including correction based on the coolant temperature correction. TTOTAL indicates the total value of the various corrections for atmospheric pressure, etc., conducted by addition (but does not include the fuel injector dead time, etc., which is added separately at the time of outputting the output quantity of fuel injection Tout).

When the result in S18 is NO, since this means that the control should be conducted in open-loop fashion, the program goes to S32 in which the feedback correction coefficient KFB is set to 1.0, and to S28 in which the output quantity of fuel injection Tout is determined in the manner stated above. If S12 finds that the engine is cranking, the program goes to S34 in which the quantity of fuel injection at cranking Ticr is retrieved, and then to S36 in which Ticr is used to calculate the output quantity of fuel injection Tout based on an equation for engine cranking. If S14 finds that fuel cutoff is in effect, the output quantity of fuel injection Tout is set to 0 in S38.

The calculation of the dead time d' will now be explained.

Figure 6:
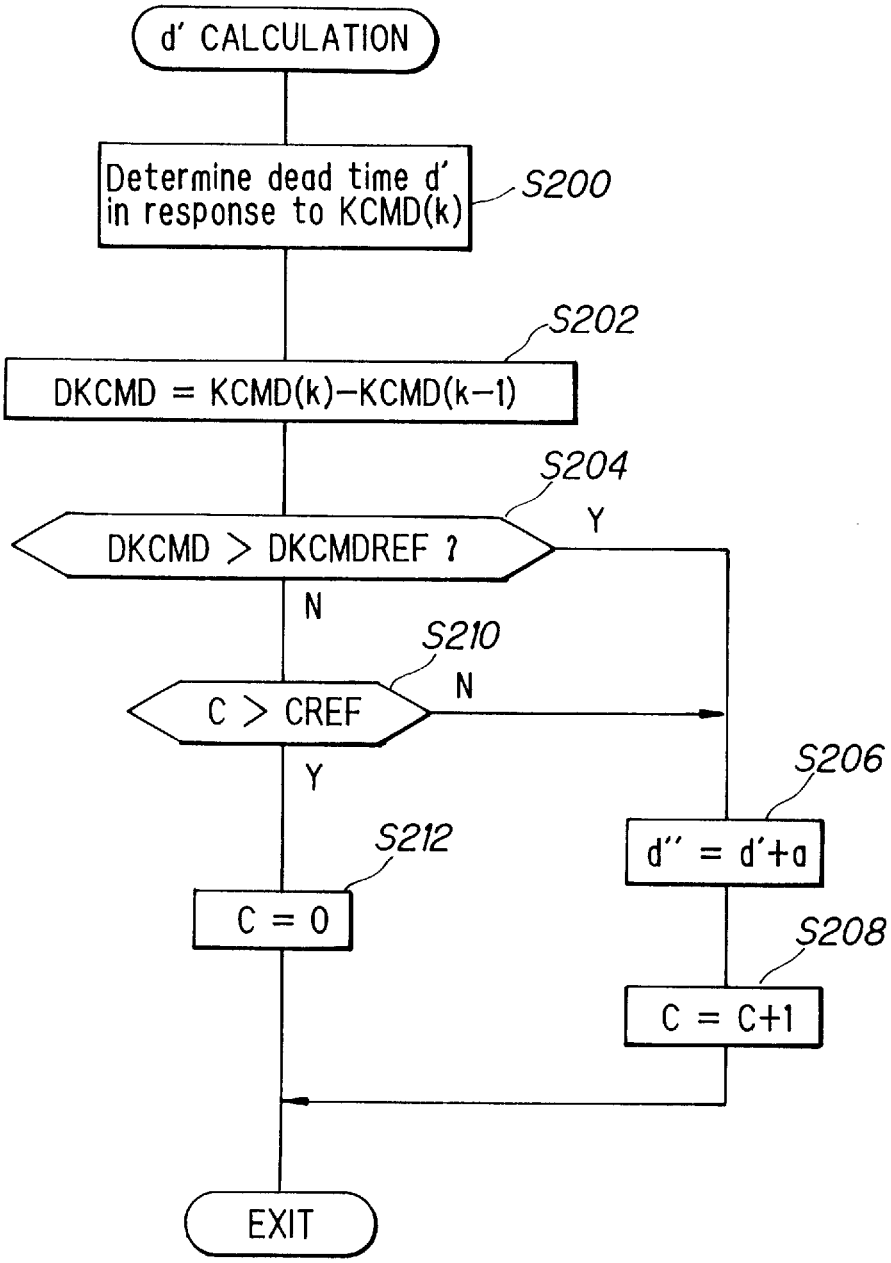
FIG. 6 is a subroutine flowchart of FIG. 3 showing the calculation of a dead time d' referred to in FIG. 3.

FIG. 6 is a flowchart showing a subroutine of the calculation.

Figure 7:
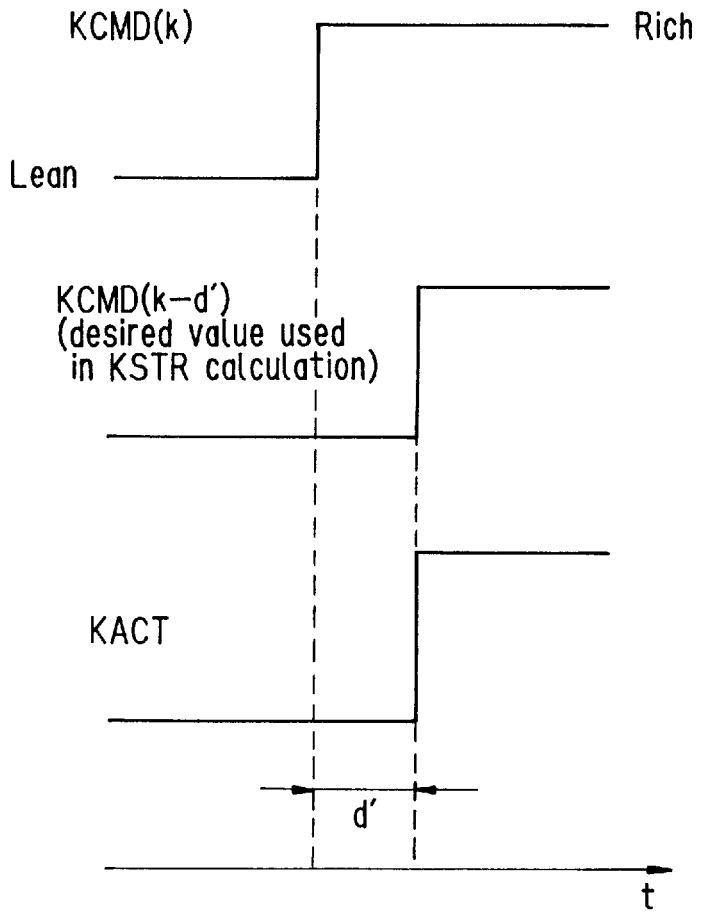
FIG. 7 is a timing chart showing the behavior of the detected exhaust air/fuel ratio when the dead time is properly determined.

Before entering the explanation of the figure, however, the dead time will firstly be explained more specifically with reference to FIG. 7 and on.

FIG. 7 is a timing chart illustrating the behavior of the detected exhaust air/fuel ratio KACT, in which the dead time d' is determined correctly, i.e., the desired value KCMD(k–d') is determined properly to be equal to its actual or true value such that the adaptive correction coefficient KSTR is calculated correctly in the manner shown in Eq. 12. As illustrated, KACT follows KCMD with a delay time of d'. By thus determining the dead time d' correctly, it is possible to carry out the fuel metering control as desired. The embodiment is configured in its basic aspect such that in its basic aspect the dead time d' is thus determined correctly to be equal to the actual value in response to the desired air/fuel ratio.

Figure 8:
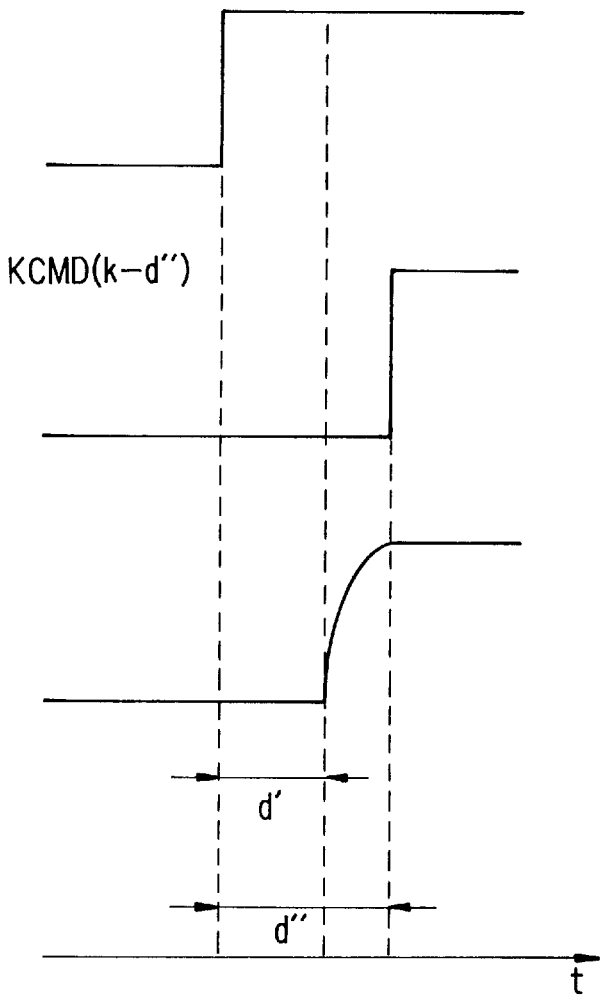
FIG. 8 is a timing chart, similar to FIG. 7, but showing the behavior of the detected exhaust air/fuel ratio when the dead time is intentionally varied from its proper value.

FIG. 8 is a similar timing chart, in which the dead time is intentionally or deliberately varied from the proper value d' to an intentionally varied value d", so as to improve vehicle drivability. Here, the relationship therebetween should be:

$$d'<d''$$

When the dead time is shifted from the proper value d' as shown in FIG. 8, it will be easily understood that the control response degrades or becomes worse. This is because the adaptive controller (STR controller) reacts to slowly follow the desired value change with a delay time longer than the actual or correct dead time. With the arrangement, the detected value will eventually be smoothed. Therefore, when the desired air/fuel ratio is varied greatly in a lean burn controlled engine, for example, it becomes possible to decrease torque shock and enhance vehicle drivability by lowering the response of the adaptive controller intentionally.

Explaining the FIG. 6 flowchart based on the above, the program starts at S200 in which the dead time d' to be used in the calculation of the adaptive correction coefficient KSTR in Eq. 12, is determined in response to the desired air/fuel ratio KCMD(k). Specifically, the dead time d' is determined to be a time which corresponds to the time of detected value KACT(k), more specifically, the time (kd') of the desired value is determined with respect to KACT(k) such that a target value at the time (k–d') corresponds to the time k at which the value KACT is detected. By this, the control can be conducted as initially desired.

The program then goes to S202 in which the difference DKCMD of the desired air/fuel ratio KCMD between its current control cycle value (current program loop) KCMD (k) and its last control cycle value (previous program loop) KCMD(k−1) is calculated to discriminate whether the desired air/fuel ratio changes in the rich direction or in the lean direction, and to S204 in which the difference DKCMD is compared with a reference value DKCMDREF. The reference value should be predetermined to make it possible to discriminate whether or not the desired air/fuel ratio changes in the rich direction by comparing itself with the difference.

When the result in S204 is affirmative, the program proceeds to S206 in which a positive value a is added to the proper dead time d', and to S208 in which a counter C is incremented. In the next program loop (control cycle) and on, each time the result in S204 is YES, the program goes to S206 and S208 to increment the counter and when S210 finds that the counter value C exceeds a predetermined value CREF, the program advances to S212 in which the counter value C is reset to zero. As will be apparent from the above, since the coefficient KSTR is consecutively calculated using the dead time d", the behavior of the detected exhaust air/fuel ratio KACT is kept to be smoothed for a period corresponding up to the counter value CREF, as shown in FIG. 8.

In the embodiment, since the dead time d' is firstly determined correctly in response to the desired value KCMD (K) to be equal to the actual delay time so that the adaptive correction coefficient KSTR is calculated properly, it becomes possible to obtain the detected value KACT, as expected, that is inherently determined by the LAF sensor response, and to conduct the fuel metering control as desired. If only this purpose is to be achieved, S202 and on are not necessary in the FIG. 6 flowchart.

Moreover, since the embodiment is further configured such that the dead time is intentionally elongated to smooth the detected value KACT, when the desired air/fuel ratio is varied greatly in a lean burn controlled engine from the lean side to the rich side, for example, it becomes possible to smooth the engine output torque so as to decrease torque shock, thereby enhancing vehicle drivability.

Figure 9:
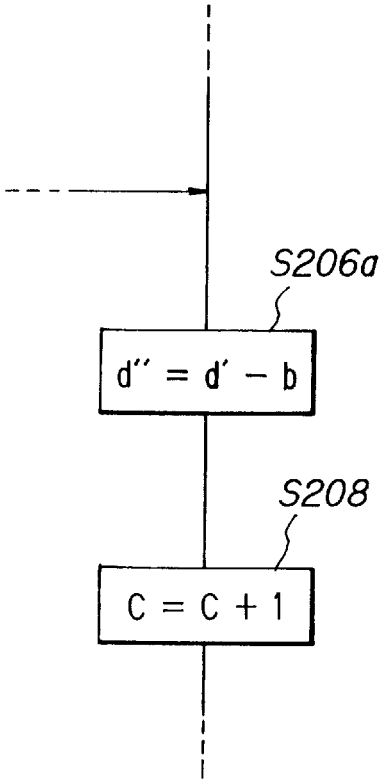
FIG. 9 is a flowchart, similar to a portion of the FIG. 6 flowchart, but showing a second embodiment of the invention.

FIG. 9 is a flowchart, similar to a portion of FIG. 6, but showing a second embodiment of the invention.

Figure 10:
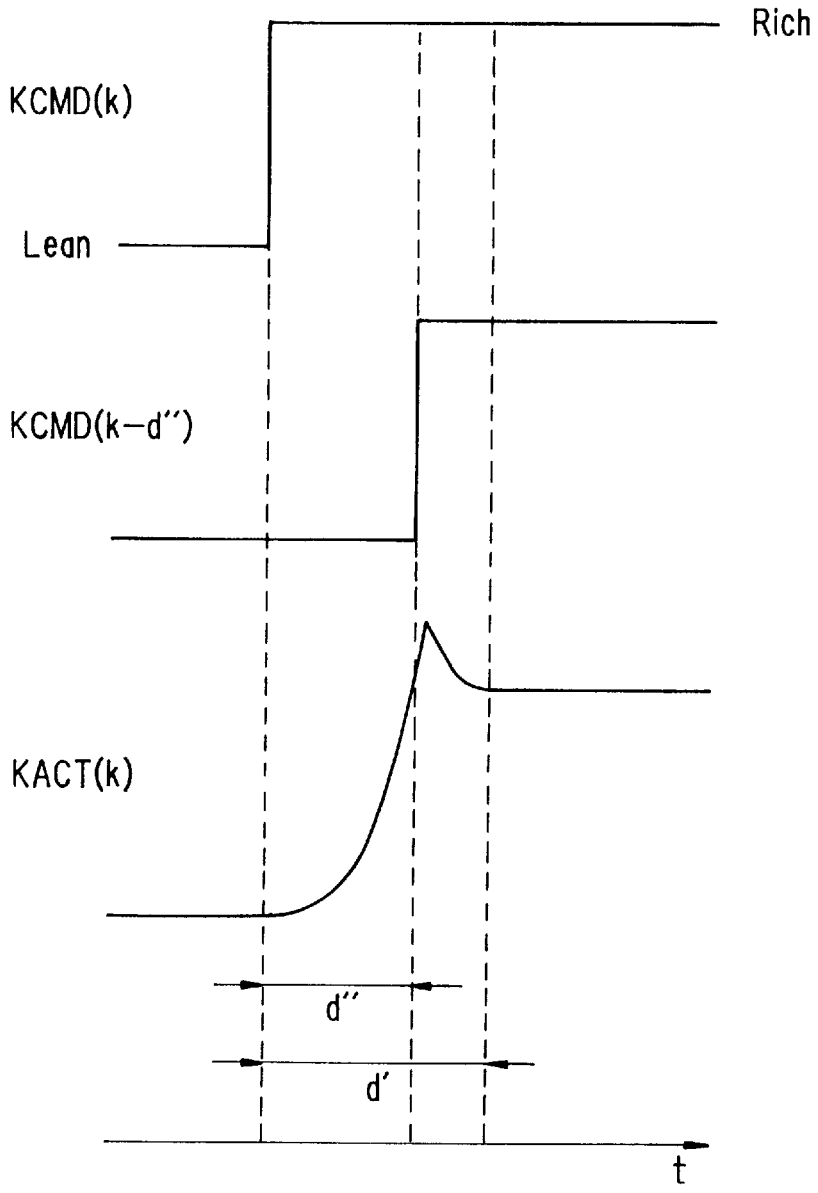
FIG. 10 is a timing chart showing the behavior of the detected exhaust air/fuel ratio when the dead time is intentionally varied in the manner shown in FIG. 9.

In the second embodiment, a positive value b is subtracted from the proper value d' to decrease the dead time in S206*a* in FIG. 9 that corresponds to S206 in FIG. 6. FIG. 10 shows the behavior of the detected value KACT in the second embodiment. As shown, the detected value overshoots, rather than undershoots, a target value.

The configuration of the second embodiment is advantageous when conducting, for example, a fuel adhesion correction. In correcting the quantity of fuel injection by the amount of fuel adhered on the intake manifold floor, a fuel adhesion correction value is usually prepared in advance as mapped data to be retrieved by parameters such as the engine speed and manifold pressure, while assuming the engine coolant temperature is normal. When the map retrieval value is to be used in the engine operating condition in which the coolant temperature is low, it becomes possible to compensate for the fuel adhesion correction amount, if insufficient, with overcorrection by determining the dead time as:

$$d'>d''$$

The above is in contrast with the undershooting characteristics shown in FIG. 8 when the dead time is determined as:

$$d'<d''$$

Thus, by selecting either of the characteristics of the first or second embodiments, it becomes possible to make the adaptive controller operate to cancel a spike, if one occurs, of the air/fuel ratio.

Furthermore, although not described in detail, there will be a need to vary the dead time when the volume of the exhaust manifold is configured to be variable, or when the valve timing characteristics of the variable valve timing mechanism are switched. The configuration of the first and the second embodiment will be useful in adjusting the dead time in those cases.

Although only the correction coefficient obtained by the high response adaptive controller is used as the feedback correction coefficient in the first and second embodiments, it is alternatively possible to prepare another correction coefficient calculated by a low response controller such as a PID controller and to switch them in the feedback control region.

Although the air/fuel ratio is used as the desired value in the first and second embodiments, it is alternatively possible to use the quantity of fuel injection itself as the desired value.

Although the feedback correction coefficient is determined as a multiplication coefficient in the first and second embodiments, it can instead be determined as an additive value.

Although a throttle valve is operated by the stepper motor in the first and second embodiments, it can instead be mechanically linked with the accelerator pedal and be directly operated in response to the accelerator depression.

Furthermore, although the aforesaid embodiments are described with respect to examples using STR, MRACS (model reference adaptive control systems) can be used instead.

Although the invention has thus been shown and described with reference to specific embodiments, it should be noted that the invention is in no way limited to the details of the described arrangements but changes and modifications may be made without departing from the scope of the invention, which is defined by the appended claims.

What is claimed is:

1. A system for controlling fuel metering for a multi-cylinder internal combustion engine, comprising:

an air/fuel ratio sensor located in an exhaust system of the engine for detecting an air/fuel ratio in exhaust gas of the engine;

engine operating condition detecting means for detecting engine operating conditions including at least engine speed and engine load;

basic fuel injection quantity determining means coupled to said engine operating condition detecting means, for determining a basic quantity of fuel injection for a cylinder of the engine based on at least the detected engine operating conditions;

a feedback loop means coupled to said fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value determined earlier by a dead time;

output fuel injection quantity determining means for determining an output quantity of fuel injection, said output fuel injection quantity determining means correcting the basic quantity of fuel injection using said feedback correction coefficient when engine operation is discriminated to be in a feedback control region; and fuel injection means coupled to said output fuel injection quantity determining means, for injecting fuel into the cylinder of the engine based on the output quantity of fuel injection;

wherein:

dead time determining means are operatively coupled to said feedback loop means, for determining the dead time in response to the detected engine operating conditions.

2. A system according to claim 1, wherein the desired value is a desired air/fuel ratio, and said dead time determining mean determines the dead time such that the dead time corresponds to a time at which the air/fuel ratio is detected.

3. A system according to claim 2, wherein said dead time determining means continues to determine the dead time for a predetermined period.

4. A system according to claim 2, wherein said feedback loop means sets the internal variables of the adaptive controller such that the feedback correction coefficient is a predetermined value, when the engine operation has shifted from an open-loop control region to the feedback control region.

5. A system according to claim 1, wherein the desired value is a desired air/fuel ratio, and said dead time determining means determines the dead time such that the dead time is a time that does not correspond to a time at which the air/fuel ratio is detected.

6. A system according to claim 5, wherein the time is determined to be greater than the time.

7. A system according to claim 5, wherein the time is determined to be less than the time.

8. A system according to claim 1, wherein said dead time determining means continues to determine the dead time for a predetermined period.

9. A system according to claim 5, wherein said dead time determining means continues to determine the dead time for a predetermined period.

10. A system according to claim 5, wherein said feedback loop means sets the internal variables of the adaptive controller such that the feedback correction coefficient is a predetermined value, when the engine operation has shifted from an open-loop control region to the feedback control region.

11. A system according to claim 1, wherein said feedback loop means sets the internal variables of the adaptive controller such that the feedback correction coefficient is a predetermined value, when the engine operation has shifted from an open-loop control region to the feedback control region.

12. A system according to claim 11, wherein the feedback correction coefficient is a predetermined value that is multiplied by the basic quantity of fuel injection.

13. A system according to claim 12, wherein the predetermined value is 1.0 or thereabout.

14. A system according to claim 1, wherein the internal variables are expressed in a recursion formula.

15. A computer program controlled system for controlling fuel metering for a multi-cylinder internal combustion engine, comprising:

an air/fuel ratio sensor located in an exhaust system of the engine for detecting an air/fuel ratio in exhaust gas of the engine;

engine operating condition detecting means for detecting engine operating conditions including at least engine speed and engine load;

basic fuel injection quantity determining means coupled to said engine operating condition detecting means, for determining a basic quantity of fuel injection for a cylinder of the engine based on at least the detected engine operating conditions;

a feedback loop means coupled to said fuel injection quantity determining means, and having an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value determined earlier by a dead time;

output fuel injection quantity determining means for determining an output quantity of fuel injection, said output fuel injection quantity determining means correcting the basic quantity of fuel injection using said feedback correction coefficient when engine operation is discriminated to be in a feedback control region; and fuel injection means coupled to said output fuel injection quantity determining means, for injecting fuel into the cylinder of the engine based on the output quantity of fuel injection;

wherein:

dead time determining means are operatively coupled to said feedback loop means, for determining the dead time in response to the detected engine operating conditions.

16. A computer program controlled system according to claim 15, wherein the desired value is a desired air/fuel ratio, and said dead time determining mean determines the dead time such that the dead time corresponds to a time at which the air/fuel ratio is detected.

17. A computer program controlled system according to claim 15, wherein the desired value is a desired air/fuel ratio, and said dead time determining means determines the dead time such that the dead time is a time that does not correspond to a time at which the air/fuel ratio is detected.

18. A computer program controlled system according to claim 15, wherein said dead time determining means continues to determine the dead time for a predetermined period.

19. A computer program controlled system according to claim 15, wherein said feedback loop means sets the internal variables of the adaptive controller such that the feedback correction coefficient is a predetermined value, when the engine operation has shifted from an open-loop control region to the feedback control region.

20. A computer program controlled system according to claim 15, wherein the internal variables are expressed in a recursion formula.

21. A method for controlling fuel metering for a multi-cylinder internal combustion engine, comprising the steps of:

detecting an air/fuel ratio in exhaust gas of the engine;

detecting engine operating conditions including at least engine speed and engine load;

determining a basic quantity of fuel injection for a cylinder of the engine based on at least the detected engine operating conditions;

feedback controlling with an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value determined earlier by a dead time;

determining an output quantity of fuel injection, while correcting the basic quantity of fuel injection using said feedback correction coefficient when engine operation is discriminated to be in a feedback control region; and injecting fuel into the cylinder of the engine based on the output quantity of fuel injection;

wherein:

determining the dead time in response to the detected engine operating condition.

22. A method according to claim 21, wherein the desired value is a desired air/fuel ratio, and the dead time is determined such that the dead time corresponds to a time at which the air/fuel ratio is detected.

23. A method according to claim 21, wherein the desired value is a desired air/fuel ratio, and the dead time is determined such that the dead time is a time that does not correspond to a time at which the air/fuel ratio is detected.

24. A method according to claim 21, wherein the dead time is continued to be determined for a predetermined period.

25. A method according to claim 21, wherein the internal variables of the adaptive controller are set such that the feedback correction coefficient is a predetermined value, when the engine operation has shifted from an open-loop control region to the feedback control region.

26. A method according to claim 21, wherein the internal variables are expressed in a recursion formula.

27. A computer program for controlling fuel metering for a multi-cylinder internal combustion engine, said computer program comprising the steps of:

detecting an air/fuel ratio in exhaust gas of the engine;

detecting engine operating conditions including at least engine speed and engine load;

determining a basic quantity of fuel injection for a cylinder of the engine based on at least the detected engine operating conditions;

feedback controlling with an adaptive controller and an adaptation mechanism coupled to said adaptive controller for estimating controller parameters, said adaptive controller calculating a feedback correction coefficient using internal variables that include at least said controller parameters, to correct the basic quantity of fuel injection to bring a controlled variable obtained based at least on the detected air/fuel ratio to a desired value determined earlier by a dead time;

determining an output quantity of fuel injection, while correcting the basic quantity of fuel injection using said feedback correction coefficient when engine operation is discriminated to be in a feedback control region; and injecting fuel into the cylinder of the engine based on the output quantity of fuel injection;

wherein:

determining the dead time in response to the detected engine operating conditions.

28. A computer program according to claim 27, wherein the desired value is a desired air/fuel ratio, and the dead time is determined such that the dead time corresponds to a time at which the air/fuel ratio is detected.

29. A computer program according to claim 27, wherein the desired value is a desired air/fuel ratio, and the dead time is determined such that the dead time is a time that does not correspond to a time at which the air/fuel ratio is detected.

30. A computer program according to claim 27, wherein the dead time is continued to be determined for a predetermined period.

31. A computer program according to claim 27, wherein the internal variables of the adaptive controller are set such that the feedback correction coefficient is a predetermined value, when the engine operation has shifted from an open-loop control region to the feedback control region.

32. A computer program according to claim 27, wherein the internal variables are expressed in a recursion formula.

33. A system for controlling fuel metering for a multi-cylinder internal combustion engine, said system comprising:

an air/fuel ratio sensor located in an exhaust system of the engine for detecting an air/fuel ratio in exhaust gas of the engine;

engine operating condition detecting means for detecting engine operating conditions including at least engine speed and engine load;

fuel injection means coupled to said engine for injecting fuel into the cylinder of the engine;

a controller connected to said air/fuel ratio sensor, said engine operating condition detecting means and said fuel injection means, said controller being configured to determine a basic quantity of fuel injection based upon an output of said engine operating condition detecting means for a cylinder of the engine;

calculate a feedback correction coefficient using internal variables for adaptive control and based upon estimated controller parameters;

correct the basic quantity of fuel injection to bring a controlled variable obtained based on the detected air/fuel ratio to a desired value, said desired value being determined earlier by a dead time;

determine an output quantity of fuel injection, said output quantity of fuel injection being based upon the basic quantity of fuel injection and the feedback correction coefficient when engine operation is determined to be in a feedback control region;

determine the dead time based upon the engine operating conditions and the controller parameters; and control said fuel injection means to inject said output fuel injection quantity into the cylinder of the engine.

34. A system as recited in claim 33, wherein the desired value is a desired air/fuel ratio and wherein the controller is configured to determine the dead time to correspond to a time at which the air/fuel ratio is detected.

35. A system according to claim 34, wherein said controller is configured to determine the dead time for a predetermined period.

36. A system according to claim 34, wherein said controller is further configured to set internal variables therein such that the feedback correction coefficient is a predetermined value when the engine operation detecting means indicates that engine operation has shifted from an open-loop control region to a feedback control region.

37. A system as recited in claim 33, wherein the desired value is a desired air/fuel ratio and wherein the controller is configured to determine the dead time wherein the dead time is a time which does not correspond to a time at which the air/fuel ratio is detected.

38. A system according to claim 37, wherein the dead time is determined to be greater than the time at which the air/fuel ratio is detected.

39. A system according to claim 37, wherein the dead time is determined to be less than the time at which the air/fuel ratio is detected.

40. A system according to claim 37, wherein said controller is configured to determine the dead time for a predetermined period.

41. A system according to claim 37, wherein said controller is further configured to set internal variables therein such that the feedback correction coefficient is a predetermined value when the engine operation detecting means indicates that engine operation has shifted from an open-loop control region to a feedback control region.

42. A system according to claim 33, wherein said controller is configured to determine the dead time for a predetermined period.

43. A system according to claim 33, wherein said controller is further configured to set internal variables therein such that the feedback correction coefficient is a predetermined value when the engine operation detecting means indicates that engine operation has shifted from an open-loop control region to a feedback control region.

44. A system according to claim 43, wherein the controller multiplies the feedback correction coefficient by the basis quantity of fuel injection.

45. A system according to claim 44, wherein the predetermined value comprises approximately 1.0.

46. A system according to claim 33, wherein the controller is configured to express the internal variables in a recursion formula.

* * * * *